US006145597A

United States Patent [19]

Kobylinski

[11] Patent Number: 6,145,597

[45] Date of Patent: Nov. 14, 2000

[54] METHOD AND APPARATUS FOR RETAINING A CABLE IN A CONDUIT

[75] Inventor: Lee S. Kobylinski, Bartlesville, Okla.

[73] Assignee: Camco International, Inc., Houston, Tex.

[21] Appl. No.: 09/251,829

[22] Filed: Feb. 17, 1999

[51] Int. Cl.[7] ..... E21B 19/00

[52] U.S. Cl. ..... 166/384; 166/65.1; 166/369; 174/47; 174/74 B; 439/191

[58] Field of Search ..... 166/65.1, 385, 166/384, 369, 105; 174/47, 74 R, 77 R; 285/123.3; 403/348; 439/191, 192

[56] References Cited

U.S. PATENT DOCUMENTS

| | | | |
|---|---|---|---|
| 1,337,080 | 4/1920 | Krone | 174/47 X |
| 2,963,536 | 12/1960 | Kokalas | 174/77 R |
| 3,835,929 | 9/1974 | Suman | 166/385 X |
| 4,317,491 | 3/1982 | Tullos et al. | 175/57 |
| 4,444,255 | 4/1984 | Geoffrey et al. | 166/248 |
| 4,627,490 | 12/1986 | Moore | 166/106 X |
| 4,685,516 | 8/1987 | Smith et al. | 166/65.1 |
| 4,749,341 | 6/1988 | Bayh | 166/385 X |
| 4,753,291 | 6/1988 | Smith et al. | 166/65.1 |
| 4,877,089 | 10/1989 | Burns | 166/377 |
| 5,269,377 | 12/1993 | Martin | 166/385 |
| 5,392,851 | 2/1995 | Arend | 166/65.1 |
| 5,478,970 | 12/1995 | Lawler et al. | 174/74 R |
| 5,762,135 | 6/1998 | Moore | 166/65.1 |

*Primary Examiner*—Dennis L. Taylor
*Attorney, Agent, or Firm*—Fletcher, Yoder & Van Someren

[57] ABSTRACT

A technique is provided for retaining a cable assembly in a length of conduit, such as coiled tubing. The retaining assembly is secured to an end of the coiled tubing and to tensile members of the cable assembly. A retainer element may be secured directly to conductors of the cable assembly for holding the cable assembly adjacent to the retaining structure. The retainer may include a flat plate-like structure which abuts against a surface of the assembly, such as against an upper surface of a connector to prevent re-entry of the cable into the coiled tubing. Following attachment of the cable and coiled tubing, the submersible equipment coupled to the coiled tubing may be retracted or withdrawn from the well. Certain of the conductors may be coupled to monitoring circuitry for continuously monitoring well parameters during such repositioning. The technique may be used during initial installation of coiled tubing deployed systems, or during subsequent removal or servicing of the equipment.

10 Claims, 5 Drawing Sheets

METHOD AND APPARATUS FOR RETAINING A CABLE IN A CONDUIT

BACKGROUND OF THE INVENTION

1. Field of the Invention

The present invention relates to the field of cable assemblies for use with electrical equipment such as submersible pumping systems in petroleum wells. More particularly, the invention relates to a technique for retaining a cable assembly in a conduit during installation, use and servicing.

2. Description of the Related Art

A number of applications exist for electrical cable assemblies deployed within conduits. In submersible pumping systems, for example, cable assemblies extending from the earth's surface convey power to electrical equipment. The powered equipment typically includes electric motors used to drive pumps and other system components, parameter detection and measurement devices, control circuitry, data storage and transfer devices and so on. At the earth's surface the cable assemblies are coupled to power sources, such as generator sets, and to interface circuitry for the data acquisition and control of the submerged components.

In well applications, several techniques may be employed for routing and supporting cable assemblies. Historically, submersible pumping systems have often been deployed by suspending the equipment on high tensile strength cables. Power and data cables, which are generally incapable of supporting their own weight over the considerable depth of most wells, are secured to the suspension cables. In an increasing number of cases, submersible equipment is supported on lengths of coiled tubing that can be rolled, stored and transported on reels. Such arrangements, referred to as "coiled tubing deployed systems," offer considerable advantages in terms of facility of deployment and retrieval. Moreover, cable assemblies coupled to the equipment may be disposed within the coiled tubing in advance of its deployment. Connections to the submersible equipment are completed subsequently, during installation of the equipment in a well, with connections to above-ground equipment typically being made once the equipment is properly positioned in the well.

Various techniques may be employed for installing and supporting cables within conduits such as coiled tubing. For example, one known technique is to draw the cable into the tubing via a wire line of similar tension system. Alternatively, tensile and compressive forces may be applied to the cables to force them through the tubing. To support the cable, anchors may be coupled along the cable that contact interior surfaces of the tubing to transfer the cable weight to the tubing. Once installed, the tubing may be flooded with a relatively high specific gravity fluid which at least partially supports the cable by virtue of buoyant forces resulting from displacement of the fluid.

In coiled tubing deployed systems, difficulties arise in retention of cable assemblies in the coiled tubing during various phases of installation, use and servicing. In general, cables are extended well beyond the ends of the tubing upon initial installation. At the well, connections are made to the powered equipment or to field matable connectors, and the cable is trimmed to fit within the coiled tubing. At an upper end, similar connections are made to the power supply and other circuitry. For subsequent servicing, the above-ground equipment is disconnected from the cable, and the cable may be withdrawn somewhat from the tubing by pulling slack cable or by moderate elastic deformation (i.e. stretching) of the cable.

Both during initial installation and subsequent servicing of coiled tubing deployed pumping systems, a danger exists that the cable will withdraw into the conduit. In particular, residual strain or elongation may be stored in the cable to varying degrees, depending upon the technique used to position the cable in the tubing. Prior to installation at the final site, recoiling of the tubing for transport or storage may cause the cable to relax and reenter the conduit at one or both ends. During servicing, as the cable is disconnected from above-ground equipment, a similar risk of relaxation and withdrawal exists. Moreover, where sufficient space exists between the tubing inner diameter and the cable, the cable may simply drop into the tubing. In either case, once a cable end is lost within the conduit, a time consuming and expensive retrieval operation is required to extract the cable before normal service can be resumed.

There is a need, therefore, for an improved technique for restraining cables within conduits, such as coiled tubing. In particular, there is a need for a cable restraint system that can be readily employed both prior to and during initial installation of powered equipment, as well as during subsequent servicing.

SUMMARY OF THE INVENTION

The invention provides an innovative technique for handling cable in conduit, such as coiled tubing, designed to respond to these needs. The technique may be employed upon installation of submersible equipment, such as pumping systems, but is particularly well suited to retaining cables after initial installation, such as during servicing, reconnection of cable conductors, field make-up of connectors, and the like. In the technique, an upper cable end is secured to a retaining member which is prevented from entering the conduit through which the cable extends. The retaining member may be a permanent attachment on the cable, or may be temporarily secured to the cable end, such as during servicing. In a particularly favored arrangement, the retaining member is coupled to the cable conductors at the same time as a tubing connector is secured to a length of coiled tubing. Submersed equipment attached to the tubing may then be easily withdrawn from a well, serviced, and replaced in the well without the risk of the cable assembly retracting within the tubing.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
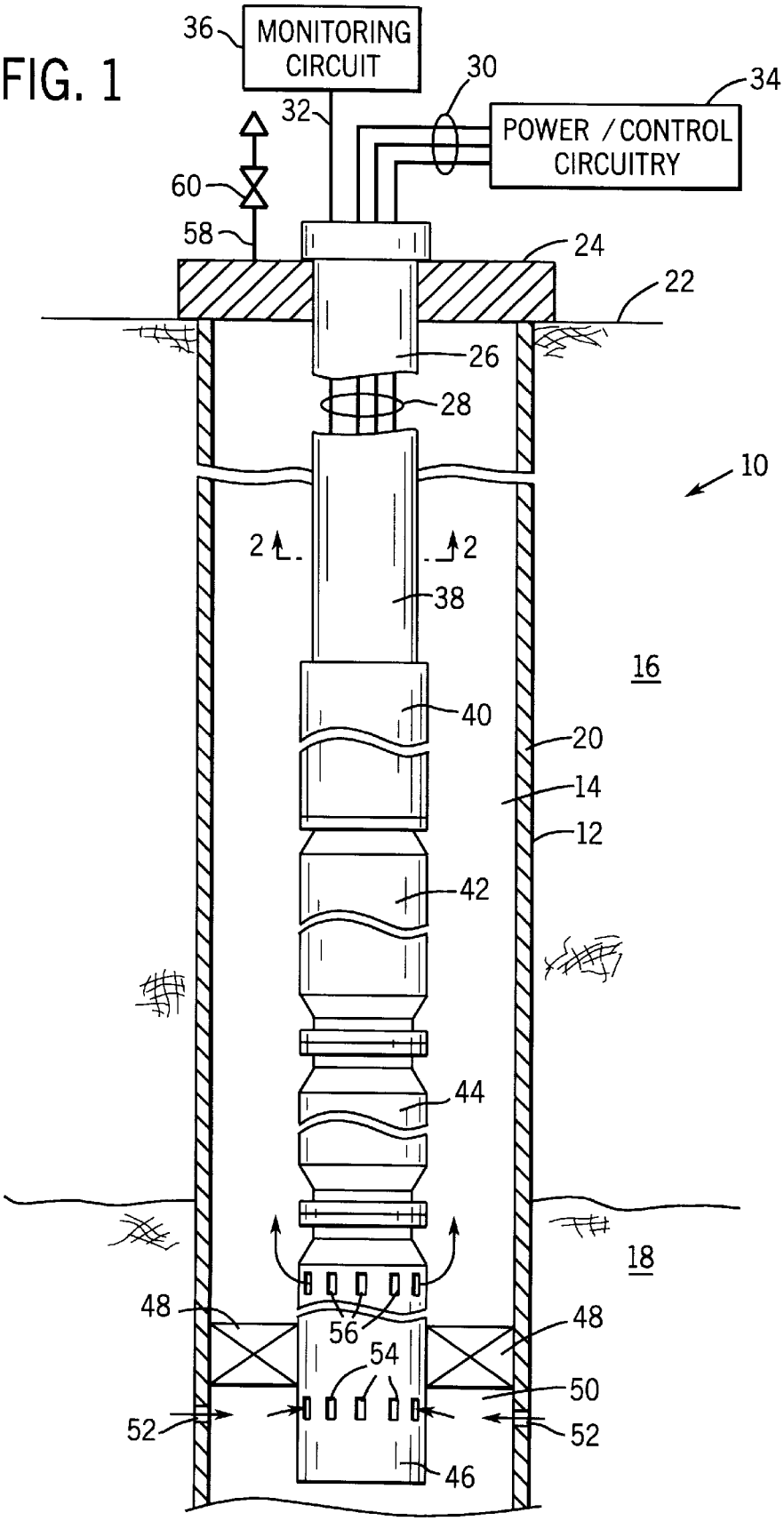
FIG. 1 is a diagrammatical elevational view of a section of well equipment in the form of a pumping system deployed in a well by means of a cable positioned in a conduit or coiled tubing.

Turning now to the drawings, and referring first to FIG. 1, a section of powered well equipment is illustrated in the form of an electrical submersible pumping system 10 deployed in a well 12. Well 12 forms a wellbore 14 which traverses a series of subterranean formations 16, and a production formation 18. Such production formations will typically bear fluid deposits of economic interest, such as oil, gas, paraffin, and the like. A casing 20 surrounds the peripheral walls of wellbore 14 to maintain stability of the wellbore through the formations. Well 12 extends to the production formations from the earth's surface as indicated at reference numeral 22.

While the arrangement illustrated in FIG. 1 is provided by way of example, it should be noted that the techniques described herein may be employed with various types of equipment and well configurations. Accordingly, these techniques may be employed with powered pumping systems, as well as production equipment, completion equipment, instrumentation components, and so forth. Similarly, the particular deployment of such equipment in wells will typically vary depending upon the completion technique used, the physical layout of the geological formations, and the manner in which the formations are to be worked. Thus, one or more production formations may be exploited, and one or more fluids may be extracted or injected into selected horizons. Moreover, well 12 may have a generally vertical orientation as shown, or may include inclined or horizontal sections along its length.

Pumping system 10 is suspended in well 12 by a length of conduit, such as coiled tubing. In the illustrated embodiment, coiled tubing 26 extends from well head 24 to the location of the pumping system. Power, control, and instrumentation signals are transmitted between the earth's surface and the pumping system via a multi-conductor cable as represented at reference numeral 28, positioned within coiled tubing 26. While a wide variety of specially-adapted conductors or lines may be provided within cable 28, in the illustrated embodiment the cable includes three power conductors as indicated at reference numeral 30, and a control line 32 for monitoring operational parameters within the well. Power conductors 30 are coupled to power and control circuitry 34 above the earth's surface. Circuitry 34 may include any suitable type of circuitry including motor drives, such as inverter driver for powering a submersible electric motor, control circuitry for regulating operation of the motor and for sensing operational parameters of the system, and so forth. Control line 32 is coupled to a monitoring circuit 36, which may include circuitry for transmitting and receiving specific parameter signals, such as signals indicative of temperatures, pressures, speeds of the submersed equipment. Alternatively, control lines 32 may be provided for transmitting pressurized fluids, such as hydraulic actuating fluids, to a submersed location, such as to engage or disengage packers, move sliding valve assemblies, inject chemicals into the well, and so forth.

A lower end 38 of coil tubing 26 is secured to a coil tubing connector 40. Coil tubing connector 40 may be configured in any suitable arrangement, and will typically include structures for gripping or seizing lower end 38 of the coiled tubing, and structures for permitting passage of the conductors of cable 28 therethrough. Coil tubing connector 40 serves, therefore, to suspend the pumping system from the coiled tubing 26.

In the illustrated embodiment, pumping system 10 includes a series of components for pumping wellbore fluids to the earth's surface. A submersible electric motor 42 is secured to the coil tubing connector 40 and receives electrical power through the connector and through cable 28. A motor protector 44 is provided for isolating cooling fluid within motor 42 from wellbore fluids and from excessive pressures which may be present in the environment in which the pumping system operates. A submersible pump 46 is drivingly coupled to motor 42 through the intermediary of motor protector 44. When driven in rotation under the power of motor 42, pump 46 displaces the fluids from the wellbore, imparting sufficient head on the fluids to force them to the earth's surface.

In the illustrated embodiment a packer 48 extends between a central portion of the pump and casing 20 to isolate a lower region 50 of the well from an upper region. A series of production perforations 52 are formed through casing 20 in the lower region and production fluids flow from formation 18 into the wellbore through these perforations. Pump 46 includes a series of inlet apertures 54 through which these fluids are drawn when the pump is driven by motor 42. A series of exhaust or discharge apertures 56 are formed at an opposite end of the pump for discharging the pumped fluids. In the illustrated embodiment, the fluids are forced upwardly to the earth's surface in an annular region between the pumping system, the coiled tubing, and the wellbore. The fluids are thus discharged through a discharge header 58 and are channeled through appropriate valving as represented at reference numeral 60, for collection and further processing.

It should be noted that the equipment illustrated in FIG. 1 described above is specifically designed as a well completion system in which production fluids flow in an annular region surrounding the pumping components and the coiled tubing. However, various alternative structures may be envisioned by those skilled in the art. For example, additional production conduits may be provided for channeling production fluids in a controlled manner without necessarily directly contacting casing 20. Similarly, liners may be provided adjacent to the peripheral wall defined by casing 20 to directly contact production fluids rising through the well.

Figure 2:
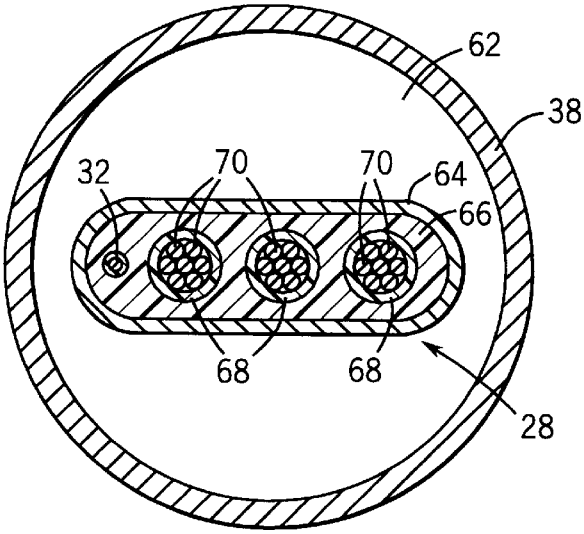
FIG. 2 is a sectional view along line 2—2 of FIG. 1 illustrating the conduit in which an armored power supply cable is positioned.

FIG. 2 illustrates in section the lower end 38 of the coiled tubing or conduit shown in FIG. 1, with cable 28 deployed therein. As shown in FIG. 2, lower end 38 surrounds cable 28 such that the cable is positioned within an internal region 62. As noted above, various forms of cables, including cables having one or more control lines, and several power and control conductors may be employed. In the illustrated embodiment, for example, cable 28 is a generally flat, armored cable, an outer surface of which is covered by a metallic armor or shielding 64. Armor 64 is wrapped about an insulative body 66 which may be made of a flexible, oil resistant rubber. Each power conductor of the assembly is surrounded by the insulative body and includes a further individual jacket or insulative cover 68. Within this jacket, one or more conductive elements 70 are positioned. In presently preferred configurations, several such power conductors may be provided, such as for driving a polyphase electric motor. In the illustrated embodiment a series of individual conductors are bundled into cables for transmitting each phase of power. As will be appreciated by those skilled in the art, such bundles may be processed to present a generally cylindrical out periphery. Similarly, cable assemblies may be used that employ a single or solid conductor for each power phase. Moreover, additional protective, shielding or insulative layers may be provided within the power conductor, such as chemical-resistant jackets. Finally, it should be noted that a variety of alternative cable configurations may be employed with the present technique, including round cables, generally triangular cables, cables employing additional control or chemical injection lines, and so forth.

When the system illustrated in FIG. 1 is initially deployed, the requisite connections are completed between the coiled tubing connector 40 and the stator leads of motor 42. The coiled tubing connector is secured to lower end 38 of the coiled tubing, with the cable assembly predeployed in the coiled tubing. The coiled tubing is then secured at its upper extremity to the well head and connections are completed between the leads of the cable and the drive, control and monitoring circuitry. As indicated above, where desired, a buoyancy fluid (not shown) may be provided in the interior region of the coiled tubing to provide additional support to the cable within the coiled tubing. Moreover, cable anchors may be provided along the length of the cable to prevent or to inhibit movement of the cable during deployment and operation.

Figure 3:
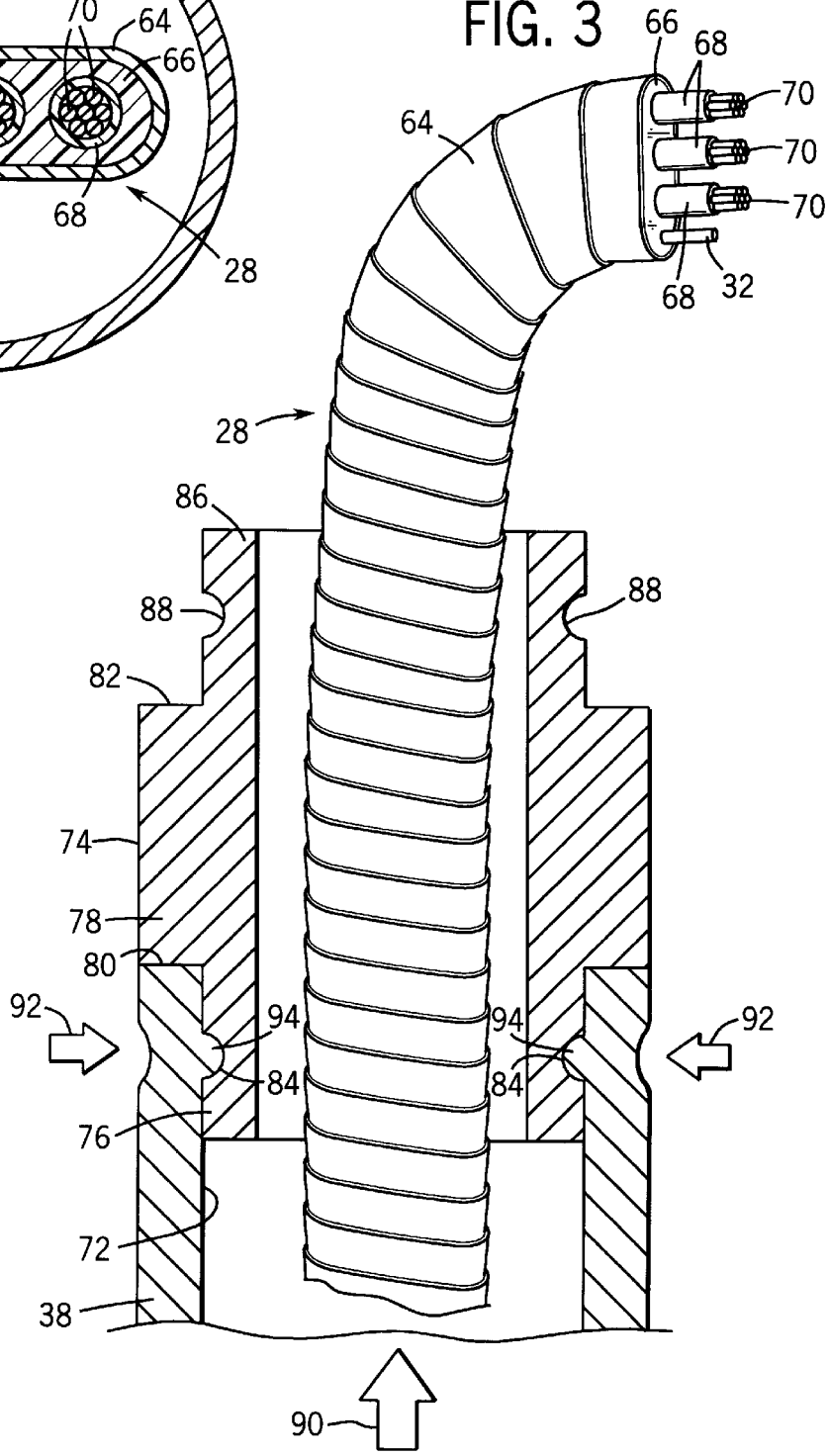
FIG. 3 is a partially sectioned diagram illustrating a presently preferred arrangement for securing an upper end of the conduit for retaining the cable during servicing of the equipment of FIG. 1.
Figure 4:
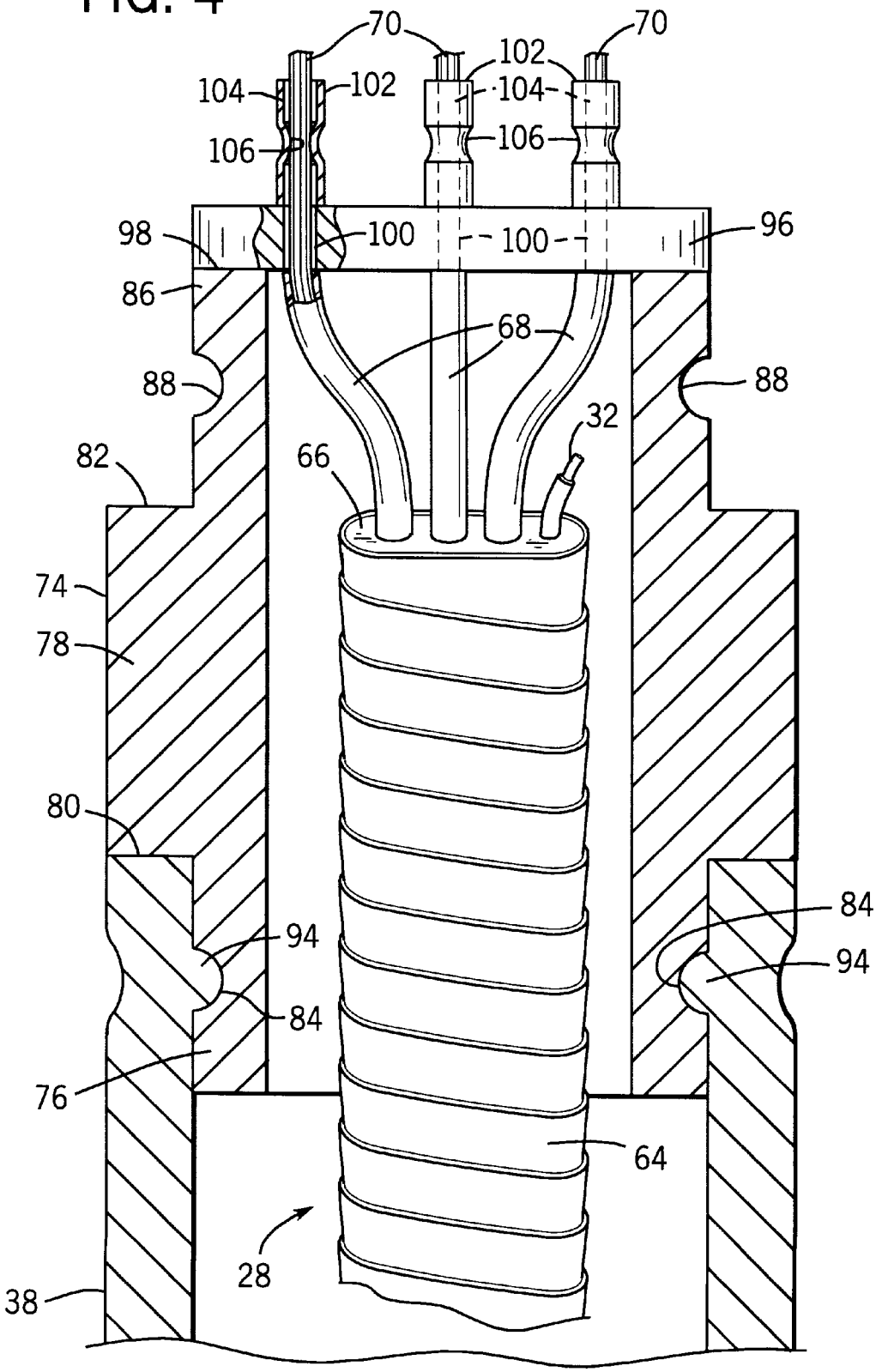
FIG. 4 is a partially sectioned elevational view following further attachment of a cable retaining arrangement to the cable and conductors illustrated in FIG. 3.
Figure 5:
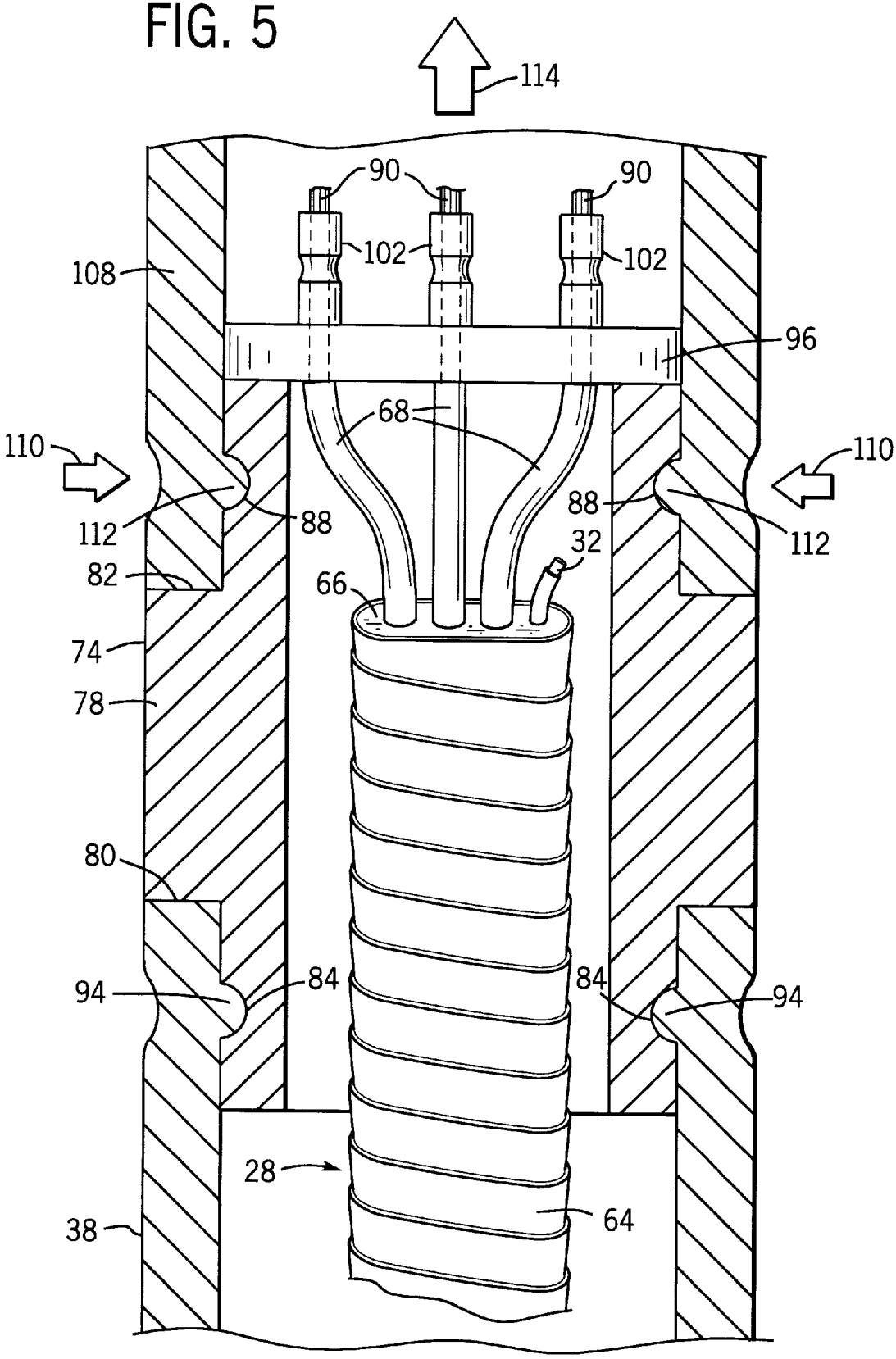
FIG. 5 is a further partially sectioned view of a cable retaining system following assembly of additional components to those illustrated in FIG. 4 for retaining the cable and removing at least a portion of the conduit from the well.

From time to time during the life of the submersible equipment, however, the need may arise to raise the equipment at least partially from its deployed position, or to otherwise alter the position of the coiled tubing or equipment in the well. In the case of certain submersible equipment, it may be necessary to completely retract the equipment from the well, from time to time, for various servicing needs. For servicing the coiled tubing or the equipment, the present technique provides for preventing the cable assembly from reentering the coiled tubing in such a manner that would otherwise require it to be retrieved through a relatively time consuming and expensive operation. FIGS. 3, 4 and 5 illustrate an exemplary technique for preventing such reentry of a cable assembly within a deploying conduit. In general, the technique provides for the cable assembly conductors to be disconnected from power equipment and secured to restraining components adjacent to the upper end of the coiled tubing. Thereafter, the coiled tubing may be withdrawn from the well and stored, such as on a conventional storage spool or reel. It has been found that the conductors of the cable are often the most reliable and strongest tensile member in the cable assembly, and thus permit reliable retention of an end of the cable in the required position at the upper extremity of the coiled tubing.

Referring now to FIG. 3, for servicing of the coiled tubing or submersed equipment, the power conductors 70 of the cable assembly are first disconnected from the power or control circuitry at the earth's surface. In one embodiment, any other control lines, such as control line 32 is also disconnected. As described more fully below, certain control lines may remain coupled, or be re-coupled to selected equipment, such as for monitoring conditions as the equipment is withdrawn from the well. Following disconnection of the conductors, the upper extremity of the coiled tubing is seized and withdrawn somewhat from the wellbore. In this condition, the internal surface 72 of the coiled tubing will present a generally uniform and fairly smooth surface. A connector 74 is then fed over the cable assembly and positioned adjacent to the upper extremity of the coiled tubing as shown in FIG. 3.

In the illustrated embodiment, the connector includes a lower end 76 which is inserted into the coiled tubing and contacts the inner surface 72 thereof. An enlarged intermediate section 78 extends above the lower end of the connector and forms a lower shoulder 80 which may be brought into butting contact with the upper end of the coiled tubing. The intermediate section 78 of the connector also presents an upper shoulder 82 used as an abutment surface for an extraction member as described below.

In the illustrated embodiment, features are formed on connector 74 to permit the coiled tubing and an upper extraction member to be easily and reliably secured to the connector. Various forms of connection may be employed, including connections which compress part or all of the sidewall of the coiled tubing, threaded connections, and the like. In the illustrated embodiment, however, a series of recesses, or a peripheral groove 84, is provided about an outer surface of lower end 76. The connector 74 includes a similar upper end 86 about which a similar series of recesses or a peripheral groove 88 is formed. When the connector has been placed within the upper end of the coiled tubing, the cable is extracted more fully from the coiled tubing as indicated by arrow 90 in FIG. 3. Thereafter, force is exerted around the outer periphery of the upper end of the coiled tubing as indicated by arrows 92, such as via hydraulic rams (not shown), to compress or crimp the coiled tubing into groove 84. The number and geometry of the grooves provided for this purpose are selected such as to provide sufficient retaining force for the entire length of the coiled tubing deployed in the well, as well as for the equipment suspended therefrom. In the illustrated embodiment, a portion of the side wall of the coiled tubing is extruded into the peripheral groove as indicated at reference numeral 94, thereby establishing mechanical resistance to extraction of the connector from the coiled tubing.

With the connector positioned in the coiled tubing and secured thereto, the conductors of the cable assembly are secured to a retaining arrangement as illustrated in FIG. 4. Where necessary, the cable assembly may require certain preparation, such as for partial removal of armor 64, insulative body 66, and so forth. Following such preparation, a retainer 96 is installed on one or more of the conductors as follows. Retainer 96, which may include an annular, star-shaped, plate-like, or similar plate component, is designed to rest on and abut against an upper end or abutment surface 98 of connector 74. Retainer 96 is also designed to receive the conductors of the cable assembly through a series of apertures 100. Once the conductors have been threaded through the apertures, cable restraints 102 in the form of elongated metallic sleeves are fed over each conductor. Each cable restraint thus forms an elongated sleeve having a central aperture 104. Each cable restraint is then secured to a respective conductor by crimping a portion of the restraint as indicated at reference numeral 106 in FIG. 4. Such crimping may be performed with specialized tools (not shown), such as mechanical compression tools, hydraulic rams, and the like. The cable restraints are physically larger than the apertures 100 provided in retainer 96, thus preventing withdrawal of the conductors through the retainer. Under the weight of the cable assembly, retainer 96 is then held securely in abutment with surface 98.

As shown in FIG. 5, the assembly is completed by securing an extraction member to the connector 74. Again, various structures may be envisaged for this purpose, including screwed, compression, and other tubular structures, as well as various cable arrangements and the like, which may be secured to the internal or external surfaces, or both, of the connector. In the illustrated embodiment however, a length of coiled tubing serves as extraction member 108. In this embodiment, the extraction coiled tubing 108 is positioned over the upper end of connector 74, about retainer 96. The extraction coiled tubing 108 may abut the upper shoulder 82 of the connector to provide a generally uniform structure protecting both the deployment coiled tubing, the connector, and the cable assembly positioned therein. Force is exerted about the lower end of the extraction coiled tubing 108 as indicated by arrows 110, such as through the use of hydraulic rams. As a result of the force, a portion of the wall of the extraction coiled tubing is extruded into groove 88 as indicated at reference numeral 112, thereby providing mechanical resistance to removal of the extraction coiled tubing from the connector. Thereafter, the extraction coiled tubing may be reeled onto a storage spool in a conventional manner, withdrawing both the cable assembly and the deployment coiled tubing in a straightforward operation, without permitting the cable assembly to be withdrawn into the deployment coiled tubing.

Following servicing, the reverse procedure is followed, reinserting the deployment coiled tubing into the well. The extraction coiled tubing is then cut from the assembly to expose retainer 96 and the cable restraints 102. The cable assembly is then partially retracted from the coiled tubing and connector 74 is may be cut from the coiled tubing to expose a free upper end thereof Thereafter, a support member may be resecured to the coiled tubing in a conventional manner at the well head. Finally, connections are reestablished between the cable conductors and the control and power circuitry, as before, after removal of cable restraints 102 and preparation of the individual conductors. Alternatively, conductor 78 may form part of a structure which is resident or permanent at the well head. In such arrangements, a retainer may be simply secured to the conductors of the cable and a coiled tubing or other extraction member secured to the connector for periodic removal. Following the removal and servicing, the extraction member is simply withdrawn from the connector and the system may be replaced in service. It should also be noted, that the present technique may be employed with cable assemblies within conduits such as coiled tubing during their initial deployment. For example, once a cable assembly of the type described above is positioned within a length of coiled tubing, a similar retaining assembly may be secured to one or both ends of the coiled tubing to prevent retraction of the cable assembly into the conduit. At the well site, the foregoing deployment steps are employed, and the cable retaining assembly may be left in place or removed once the submersible equipment is appropriately positioned within the well.

Figure 6:
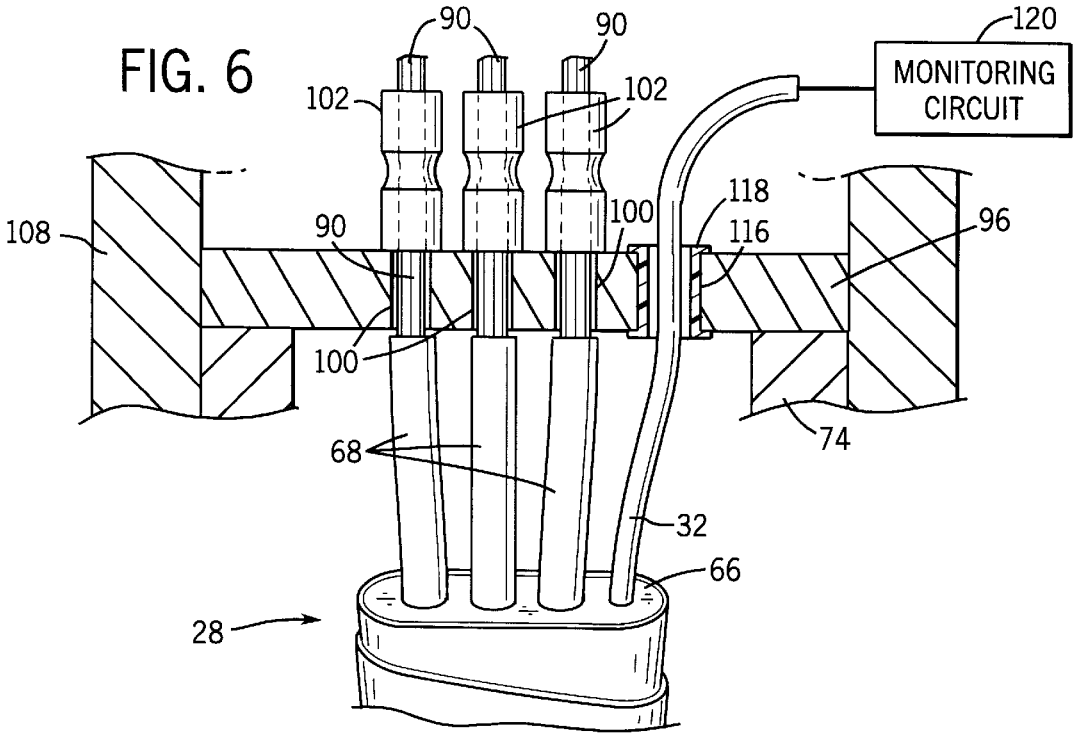
FIG. 6 is a partially sectioned view of an alternative cable retaining structure which may be used in a system such as that illustrated in FIG. 5.
Figure 7:
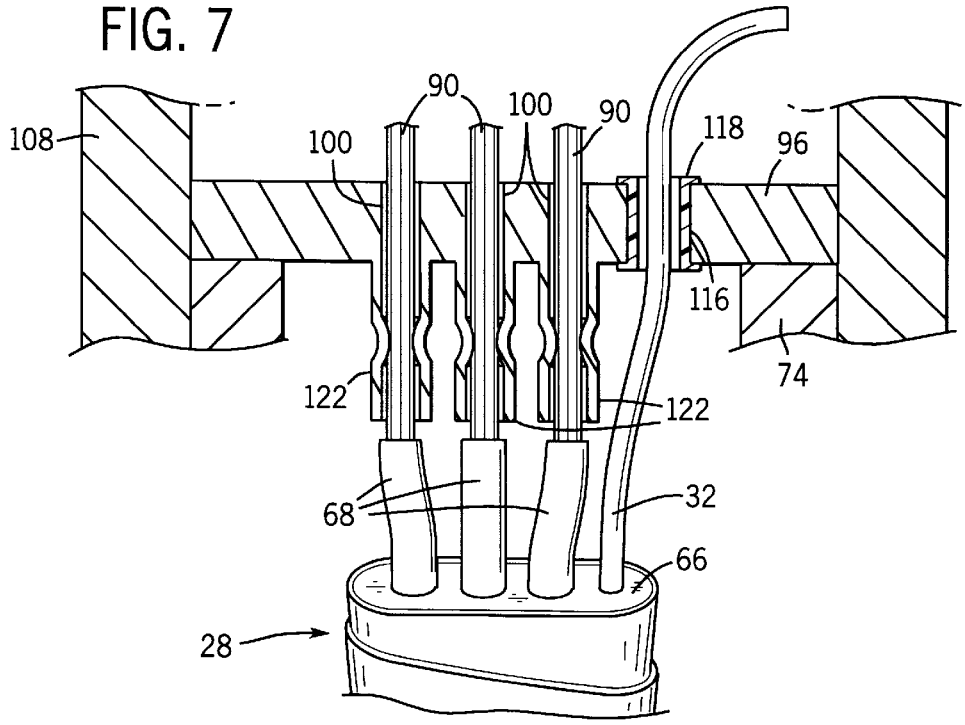
FIG. 7 is a partially sectioned diagram of a further alternative configuration of a cable retaining apparatus for use in a system such as that shown in FIG. 5.

As noted above, various alternative structures for retaining the cable assembly may be envisaged. FIGS. 6 and 7 illustrate two such alternative configurations for the retaining structure. As shown in FIG. 6, one or more of the passages in retainer 96 may be insulated to permit electrical isolation of a corresponding conductor of the cable assembly. In the embodiment illustrated in FIG. 6, a passage 116 is provided in retainer 96 for isolating control line 32 from the material of the retainer as, well as from the individual conductors of the cable. An insulative liner or sleeve 118 may be provided to further insulate the control line from the retainer and to protect the control line in its passage through aperture 116. Such insulated passage of one or more of the conductors through the retainer may be useful for monitoring well parameters during removal or repositioning of the well equipment. For example, control line 32 may be coupled to monitoring circuitry 120 following connection to retainer 96. As will be appreciated by those skilled in the art, rotary connectors, slip rings or similar structures (not shown) may be provided between the control line and the monitoring circuit, permitting the extraction member 108 and the deploying coiled tubing to be removed and stored on a storage spool while continuously monitoring well conditions.

In another presently contemplated embodiment, cable restraints may be formed integrally with retainer 96 as illustrated in FIG. 7. In this embodiment, the cable restraints extend from a lower surface of the retainer and form integral sleeves for receiving the cable conductors. Each sleeve receives an individual conductor, and the conductors are secured within the sleeves by any suitable mechanical technique, such as crimping, as described above.

While the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims. For example, while in the foregoing embodiment, retainer 96 has been described as a separate element from connector 78, in practice, these elements may be formed as a unitary or integrated structure. A similar retaining element may thus be formed across the opening of container 78, or adjacent to one or more inner peripheral sides of the connector, or elsewhere on the connector. Similarly, while in the foregoing embodiments, particularly that discussed above with reference to FIG. 6, a monitoring circuit 120 is coupled to one conductor, such as control line 32, monitoring, instrumentation, control or other circuitry, may be coupled similarly to one or more of conductors 90 within the cable assembly. Such connection may permit the well conditions at specific locations to be monitored as the equipment is either raised or lowered into the well. Such monitoring may be performed on an intermittent basis, with instrumentation being coupled to the connectors at specific points as the equipment is raised or lowered by temporarily interrupting the removal or deployment process. As mentioned above, however, where desired the monitoring may be performed through slip rings or other structures to permit continuous monitoring.

What is claimed is:

1. A method for servicing coiled tubing deployed well equipment, the well equipment being coupled to a length of coiled tubing and to a conductor extending through the coiled tubing, the method comprising the steps of:

coupling an upper end of the coiled tubing to a tubing connector;

coupling the conductor to a retainer, the retainer contacting an abutment surface to prevent retraction of the conductor into the coiled tubing; and withdrawing the equipment at least partially from the well.

2. The method of claim 1, wherein the conductor is one of a plurality of electrical conductors in a cable assembly, and wherein the method includes the step of disconnecting the plurality of electrical conductors from a source of electrical power prior to coupling the conductor to the retainer.

3. The method of claim 1, wherein the step of withdrawing the equipment includes spooling the coiled tubing and conductor on a storage reel.

4. The method of claim 1, wherein the abutment surface is defined by a portion of the tubing connector.

5. The method of claim 1, comprising the further steps of inserting the equipment into the well following servicing, and uncoupling the retainer from the conductor.

6. A method for servicing a submergible pumping system suspended in a well via a length of coiled tubing and powered via a cable assembly extending through the coiled tubing, the method comprising the steps of:

securing an upper end of the coiled tubing to a tubing connector;

uncoupling the cable assembly from a source of electrical power;

securing an upper end of the cable assembly to a cable retainer;

withdrawing at least a portion of the coiled tubing from the well; and spooling the coiled tubing and cable assembly onto a storage reel.

7. The method of claim 6, wherein the cable assembly includes a multiconductor cable and the cable retainer is secured to the conductors of the cable.

8. The method of claim 6, wherein the cable retainer is disposed at least partially within the tubing connector.

9. The method of claim 6, wherein the cable retainer contacts an abutment surface to thereby prevent the cable assembly from retracting into the coiled tubing.

10. The method of claim 9, wherein the abutment surface includes a portion of the tubing connector.

* * * * *